US009776694B2

(12) United States Patent
Oledzki

(10) Patent No.: US 9,776,694 B2
(45) Date of Patent: Oct. 3, 2017

(54) UNMANNED UNDERWATER VEHICLE WITH VARIABLE-GEOMETRY HULL

(71) Applicant: Sebastian Dawid Oledzki, Bialystok (PL)

(72) Inventor: Sebastian Dawid Oledzki, Bialystok (PL)

( * ) Notice: Subject to any disclaimer, the term of this patent is extended or adjusted under 35 U.S.C. 154(b) by 0 days.

(21) Appl. No.: 15/242,399

(22) Filed: Aug. 19, 2016

(65) Prior Publication Data

US 2017/0088242 A1 Mar. 30, 2017

(51) Int. Cl.
*B63G 8/00* (2006.01)
*B63G 8/14* (2006.01)

(52) U.S. Cl.
CPC ..... *B63G 8/001* (2013.01); *B63G 8/14* (2013.01); *B63G 2008/002* (2013.01)

(58) Field of Classification Search
CPC ..... B63G 8/001; B63G 8/14
See application file for complete search history.

(56) References Cited

U.S. PATENT DOCUMENTS 5,073,136 A * 12/1991 DeWitt ..... B63B 22/003 441/11
2002/0102912 A1* 8/2002 Duval ..... A47K 5/00 446/486
2005/0235819 A1* 10/2005 Long ..... B60P 1/6445 89/36.07
2012/0289103 A1* 11/2012 Hudson ..... F42B 19/00 440/38

* cited by examiner

*Primary Examiner* — Stephen Avila

(57) ABSTRACT

Unmanned underwater vehicle with variable-geometry internally pressurized hull that enables the underwater vehicle to submerge/emerge and change submersion depth by varying hull's buoyancy and not the vehicle weight.

14 Claims, 8 Drawing Sheets

UNMANNED UNDERWATER VEHICLE WITH VARIABLE-GEOMETRY HULL

TECHNICAL FIELD OF THE INVENTION

The invention provides an unmanned underwater vehicle with variable-geometry internally pressurized hull that enables the underwater vehicle to submerge/emerge and change submersion depth by varying hull's buoyancy and not the vehicle weight. Thus the vehicle needs not separate mechanisms for changing submersion depth, and the vehicle hull can be made lightweight; this provides for a structurally simple, lightweight, and cost-saving unmanned underwater vehicle, the payload of which can be substantially increased.

STATE OF THE ART AND BACKGROUND OF THE INVENTION

Known underwater vehicles destined to operate at varying submersion depths have rigid hulls of substantial strength, made of materials, the specific density of which is several times greater than the specific density of water. Such hulls are heavy, therefore the buoyancy/weight ratio is small, which substantially limits payload available. Moreover, steering machinery of known underwater vehicles needed to operate a vehicle at varying submersion depth includes ballast tanks, which are pressure vessels of considerable strength, hence heavy, pumps, plumbing and auxiliaries, which makes the system heavy, complicated, and costly.

Thus there is a need for an unmanned underwater vehicle of simple and lightweight construction and substantial payload.

SUMMARY OF THE INVENTION

The principal object of the instant invention is to provide a structurally simple unmanned underwater vehicle of lightweight structure.

A more specific object of the invention is to provide an unmanned underwater vehicle with simple submerging/emerging system without ballast tanks, pumps, plumbing and associated auxiliaries.

Yet more specific object of the invention is to provide an unmanned underwater vehicle with variable geometry hull, the buoyancy of which can be changed, thus enabling the vehicle to vary its submersion depth.

These and other objectives are achieved according to the invention by providing an unmanned underwater vehicle with internally pressurized, flexible hull, the buoyancy of which can be changed (preferably by changing its length), thus enabling the vehicle to vary its submersion depth. The flexible hull of the unmanned underwater vehicle according to the instant invention is filled with a gas, typically pressurized carbon dioxide, the pressure of which is adjusted so as to slightly exceed the pressure of water at given submersion depth, which allows the hull to be of exceptionally lightweight structure, and submersion depth steering system to be very simple, lightweight, and inexpensive.

BRIEF DESCRIPTION OF THE DRAWINGS

Preferred embodiment of the unmanned underwater vehicle is shown in accompanying drawings; like numerals refer to like vehicle's elements throughout all the figures.

DETAILED DESCRIPTION OF A PREFERRED EMBODIMENT

Figure 1:
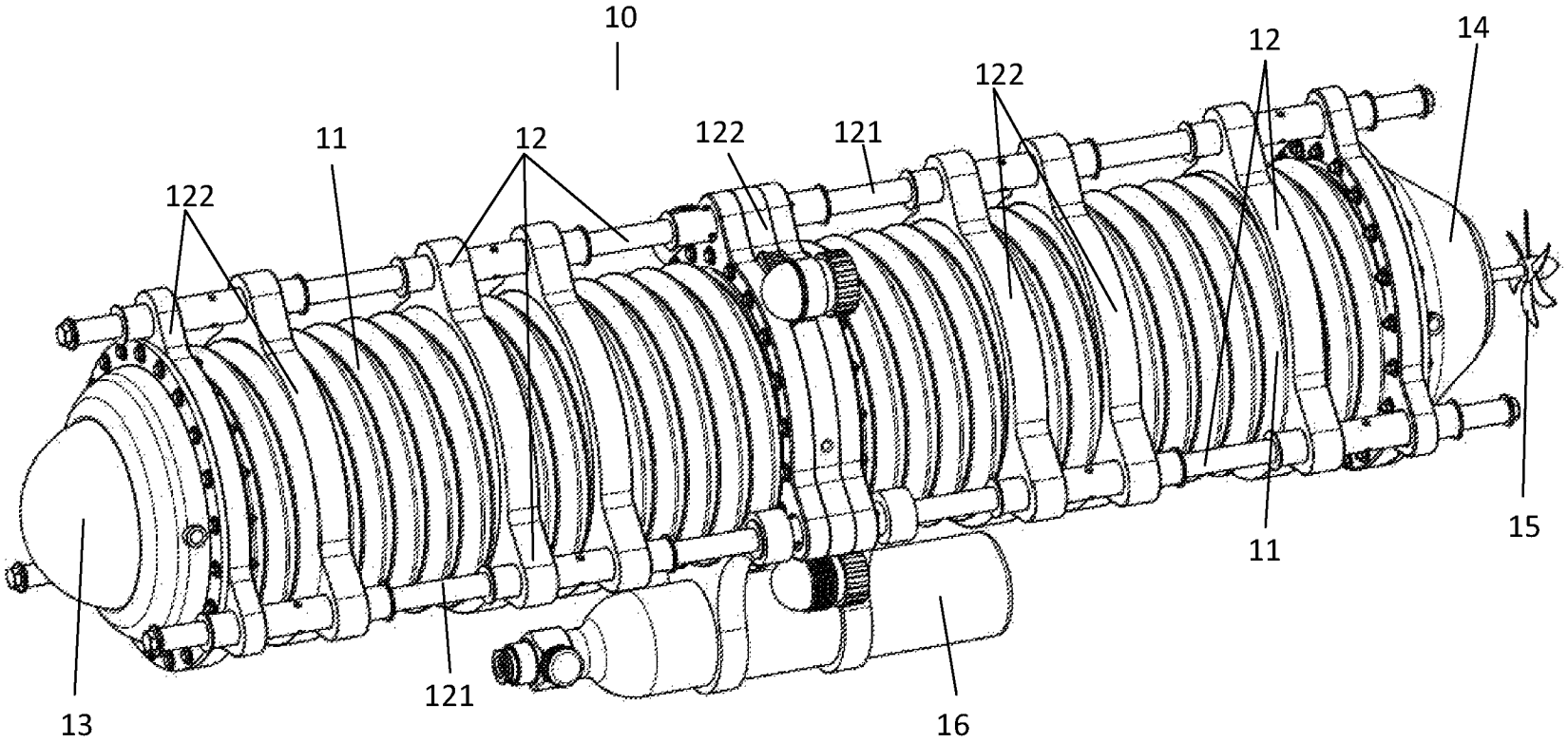
FIG. 1 is a general view of a unmanned underwater vehicle according to the instant invention, where numeral 10 refers generally to the vehicle, numeral 11 refers to the vehicle flexible hull, numeral 12 refers to the vehicle external backbone; numeral 121 refers to longitudinal guides of transversal rings 122; numeral 13 refers to a first cupola closing the hull at a first end, numeral 14 refers to a second cupola closing the hull at a second end, numeral 15 refers to propeller, and numeral 16 refers to pressurized carbon dioxide external tank.
Figure 2:
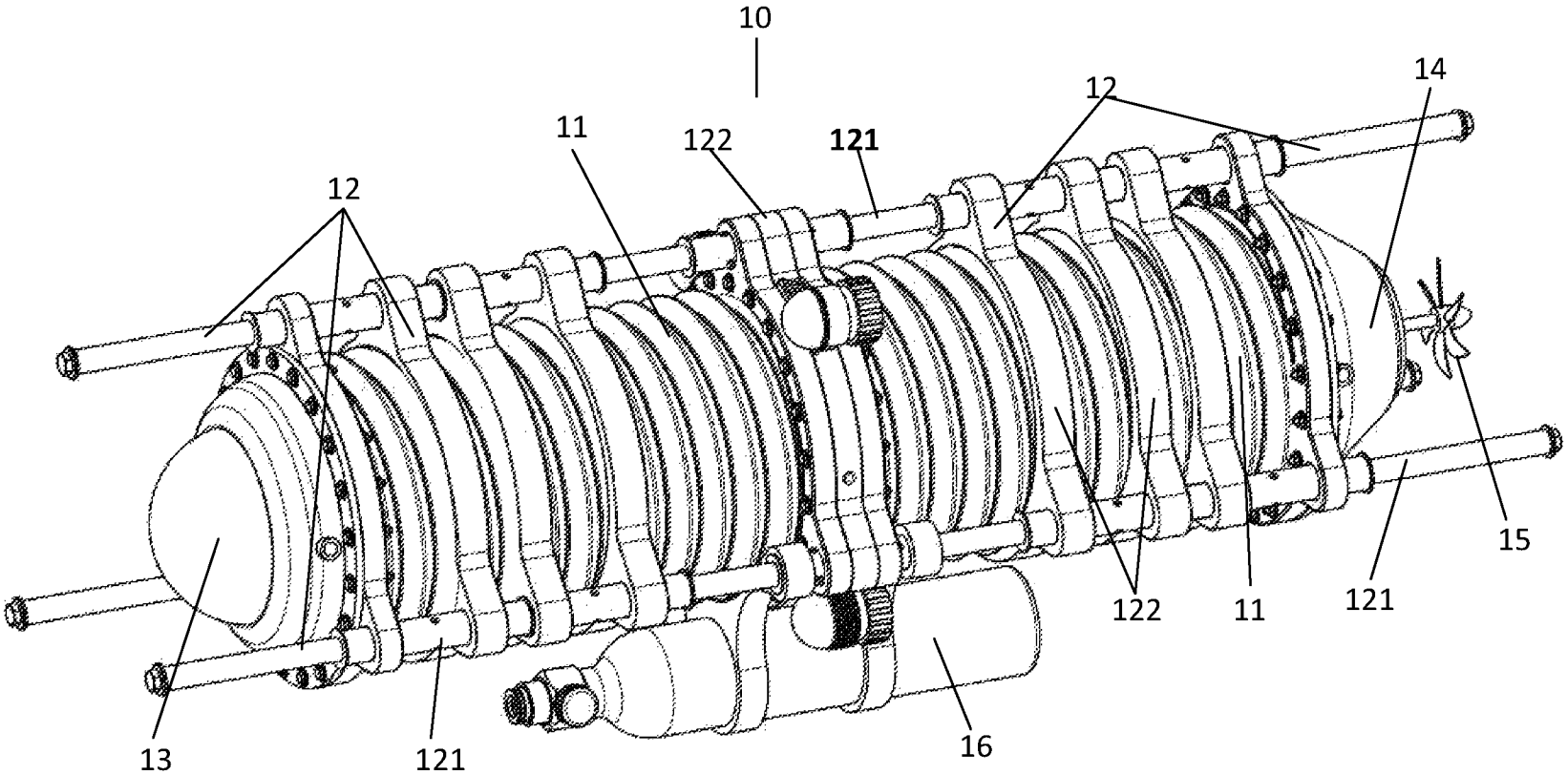
FIG. 2 is another general view of the preferred embodiment of the unmanned underwater vehicle according to the present invention, exhibiting the flexible hull in a shortened configuration in comparison with the configuration shown in FIG. 1.
Figure 3:
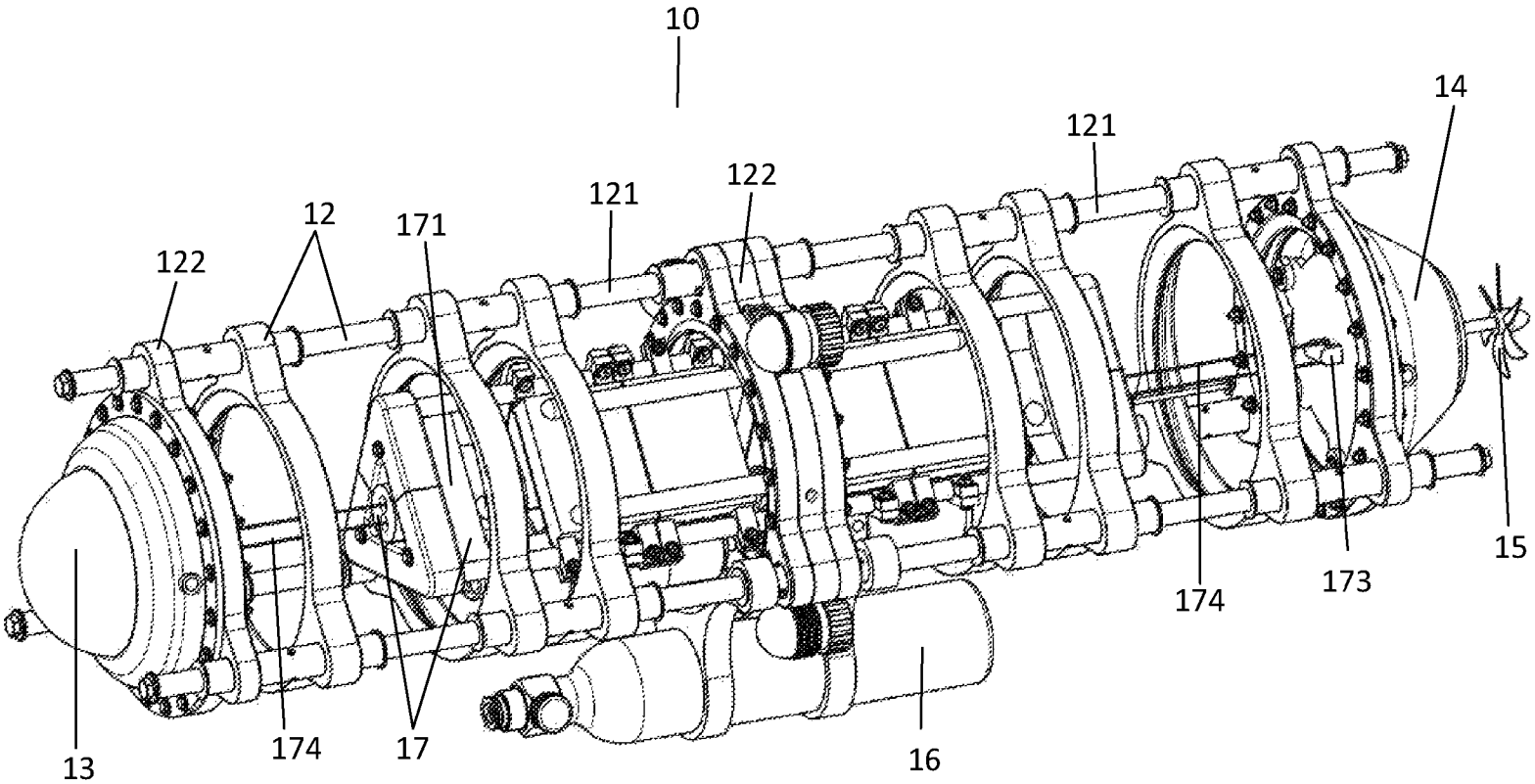
FIG. 3 is a view of the preferred embodiment of the unmanned underwater vehicle according to the present invention with the flexible hull 11 removed showing internal arrangement of the vehicle, where numeral 17 refers generally to the flexible hull length control system, numeral 171 refers to an actuator, numeral 172 refers to a front pulley, numeral 173 refers to a rear pulley, and numeral 174 refers to a cable.
Figure 4:
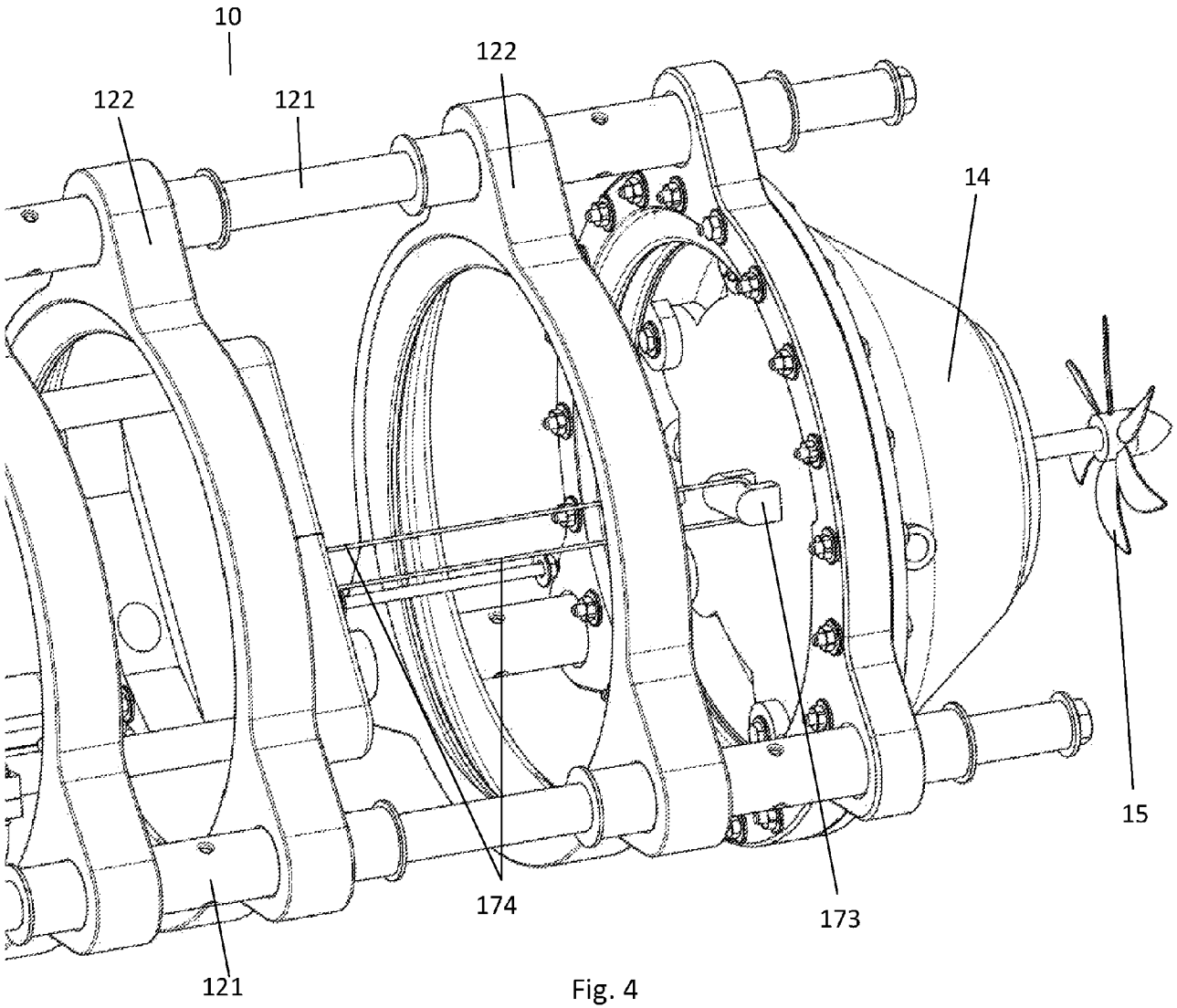
FIG. 4 is an enlarged view of the interior of the rear part of the preferred embodiment of the unmanned underwater vehicle according to the present invention.
Figure 5:
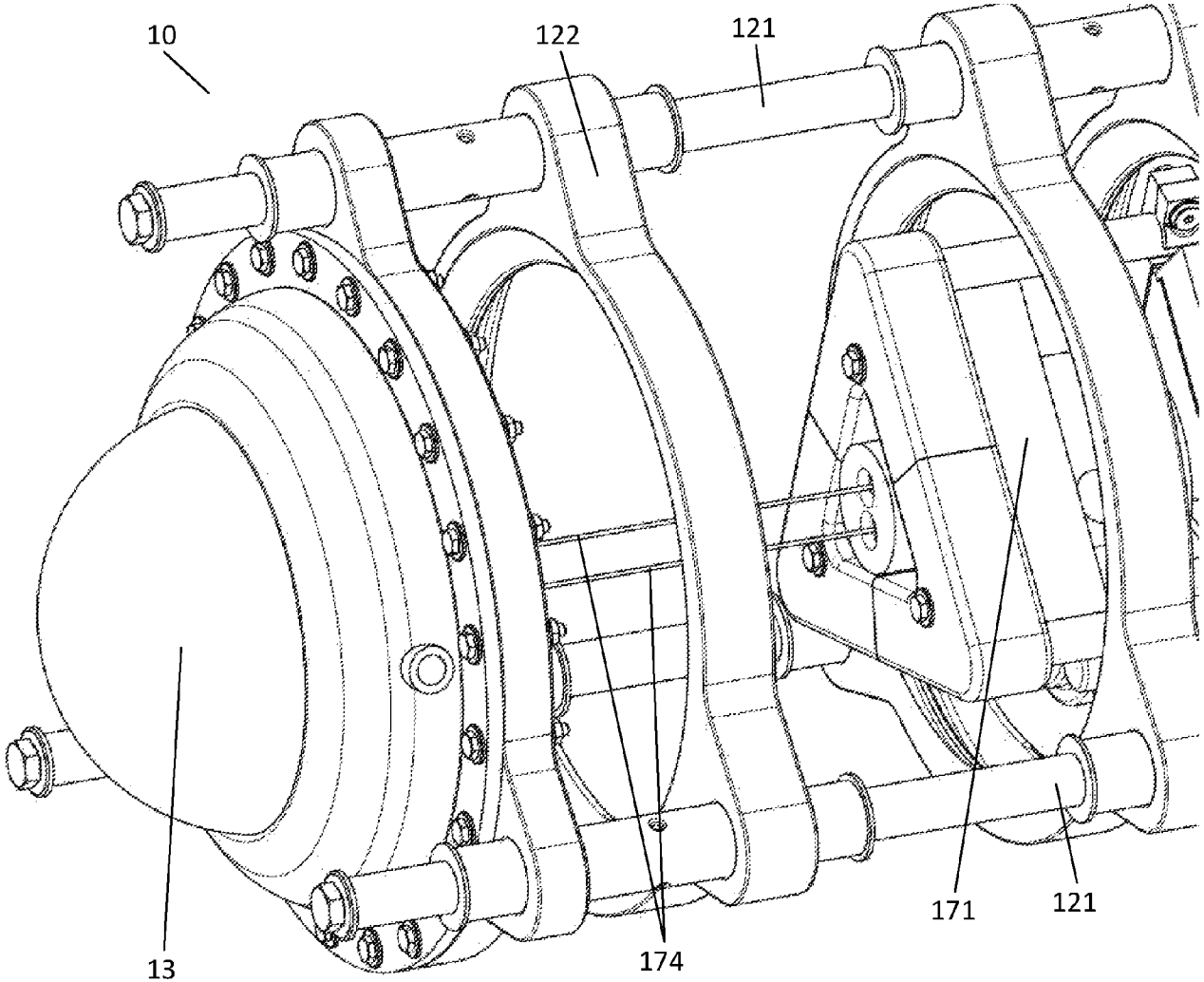
FIG. 5 is an enlarged view of the interior of the front part of the preferred embodiment of the unmanned underwater vehicle according to the present invention.
Figure 6:
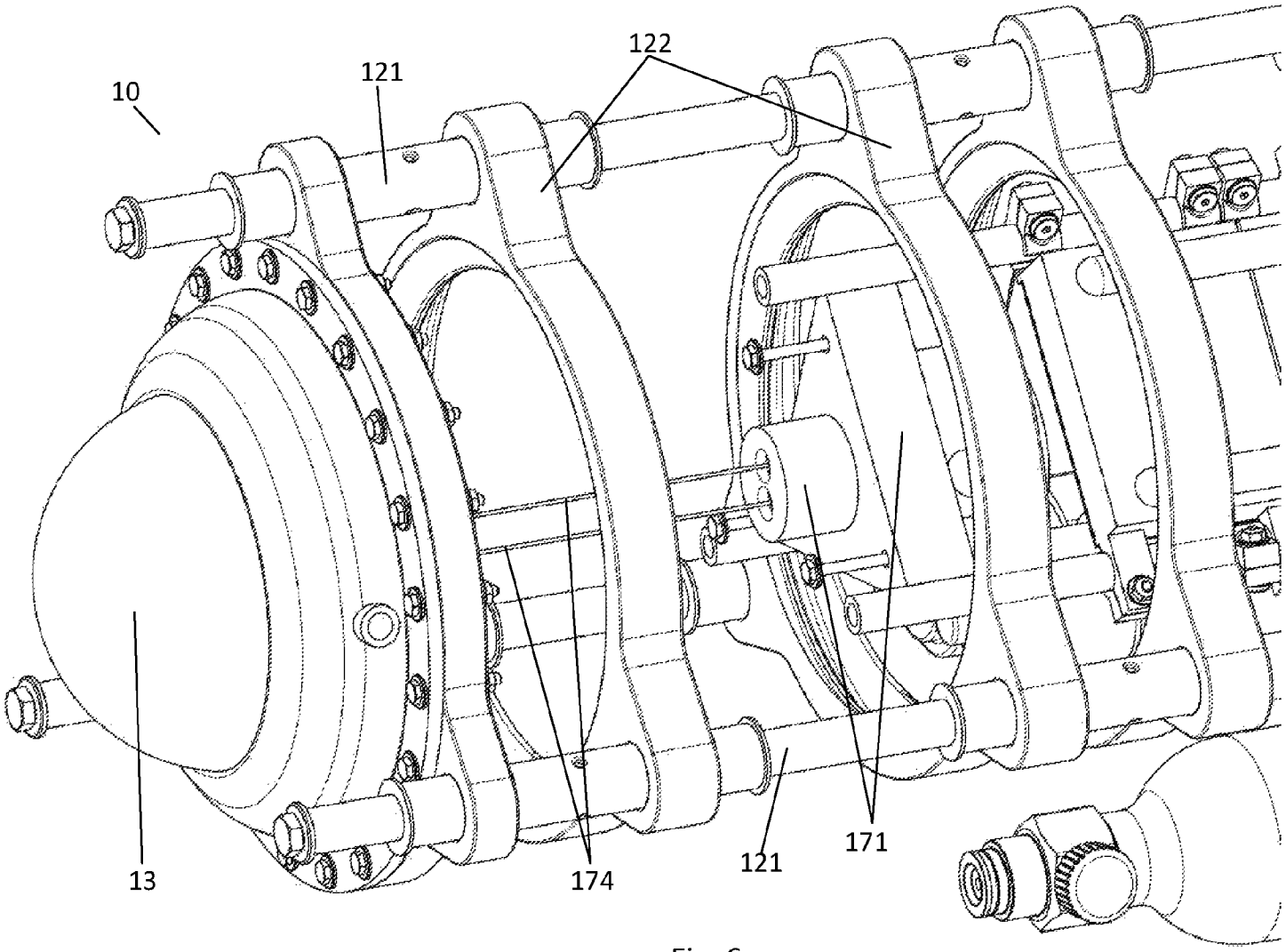
FIG. 6 is another enlarged view of the interior of the rear part of the preferred embodiment of the unmanned underwater vehicle according to the present invention, with the fastener joining the actuator 171 to the flexible hull backbone 12.
Figure 7:
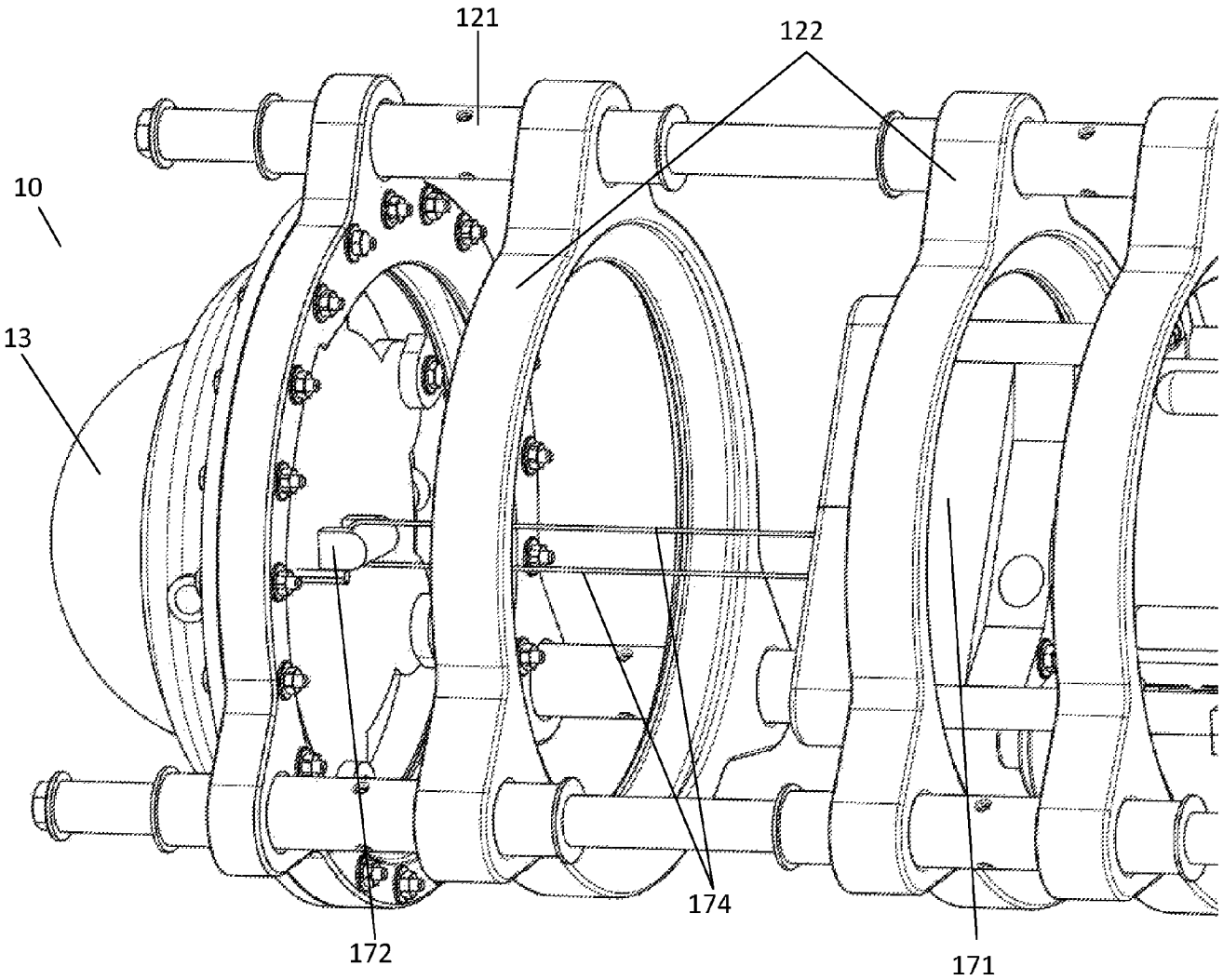
FIG. 7 is yet another enlarged view of the interior of the rear part of the preferred embodiment of the unmanned underwater vehicle according to the present invention, which shows the pulley 172 destined for adjusting the length of the front part of the flexible hull 11.
Figure 8:
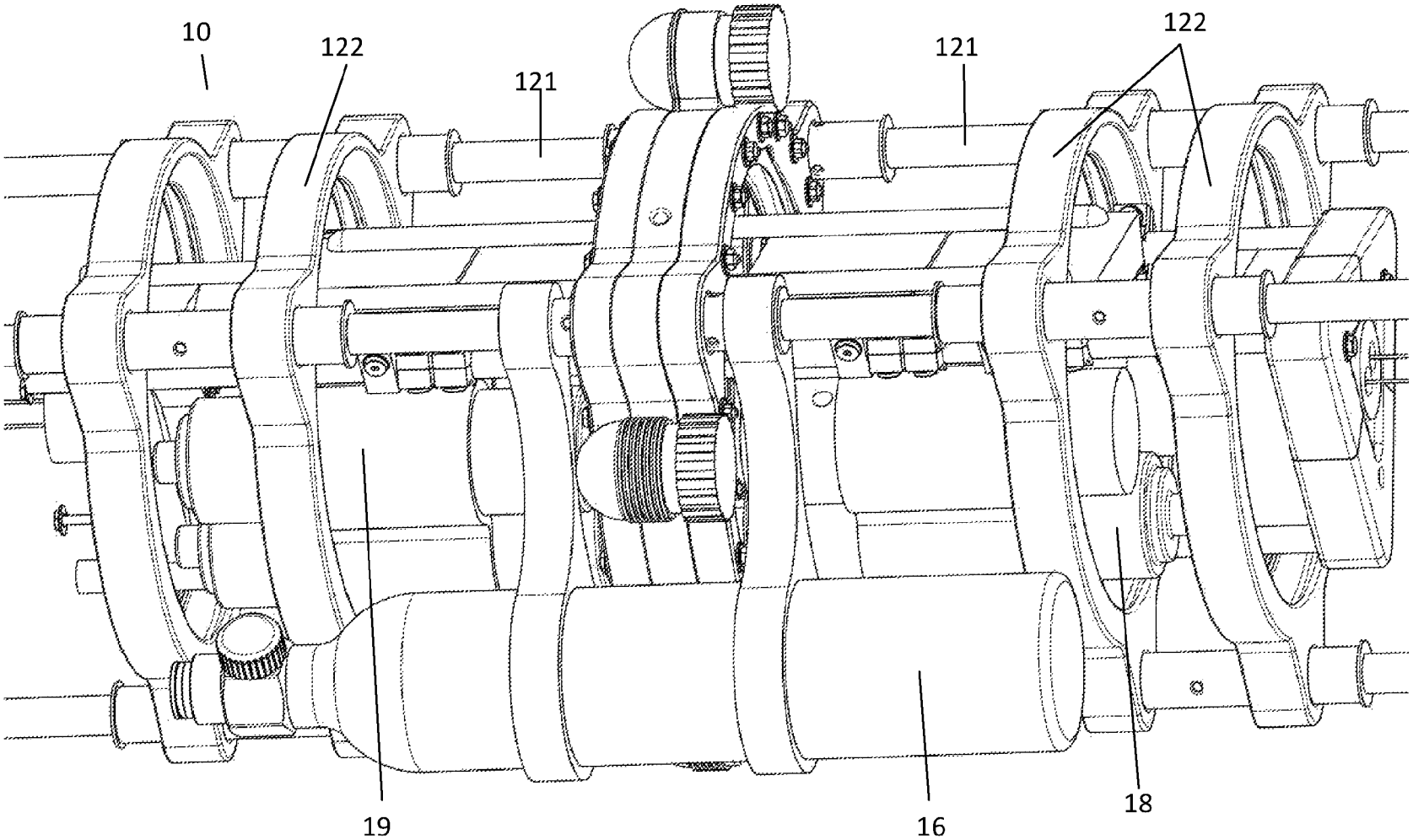
FIG. 8 is an enlarged view of the interior of the central part of the preferred embodiment of the unmanned underwater vehicle according to the present invention, where numeral 18 refers to a evaporator of liquid carbon dioxide, and numeral 19 refers to an electric accumulator.

A preferred embodiment of the unmanned underwater vehicle 10 according to the present invention, intended for illustrative purposes only, and not intended to limit the scope of the inventive ideas in any way, has a flexible hull 11 made of a flexible pipe closed at its front end by a first copula 13, and closed at its rear end by a second copula 14, where the flexible hull 11 is mounted on the external backbone 12 as described hereinafter. The external backbone 12 is composed of longitudinal guides 121, and transverse rings 122 mounted slidingly on the longitudinal guides 121. The flexible hull 11 of the preferred embodiment of the unmanned underwater vehicle 10 according to the invention is fixedly attached, e.g. by gluing, to transverse rings 122, so as the flexible hull 11 length and thus the flexible hull 12 buoyancy can be varied by sliding the transverse rings 122 over the longitudinal guides 121.

Exemplary flexible hull 10 length control system consists of at least one pneumatic, hydraulic, or electric actuator 171, a first pulley 172 fixed at the front end of the flexible hull 11, a second pulley 173 fixed at the rear end of the flexible hull 11, and a cable 174. The cable 174 is wrapped around the pulleys 172 and 173, and both the ends of the cable 174 are fixedly attached to the actuator 171. The actuator 171 changes the effective length of the cable 174 wrapped around the pulleys 172, 173 thus changing the distance between the cupolas 13 and 14 closing the flexible hull 11, causing the length and buoyancy of the flexible hull 11 to vary, thus varying the submersion depth of the unmanned underwater vehicle 10.

In order to balance the varying force exerted by water on the flexible hull 11 as the unmanned underwater vehicle 10 is submerged at varying depths, the vehicle 10 is equipped with a pressure balancing system that equates the pressure inside the flexible hull 11 with the pressure of ambient water. An exemplary pressure balancing system consists of an externally mounted liquefied carbon dioxide tank 16 fixedly attached to external backbone 12, liquefied carbon dioxide vaporizer 18 placed inside the flexible hull 11, suitable plumbing joining the liquefied carbon dioxide tank 16 with the liquefied carbon dioxide vaporizer 18 via a first steerable valve (not shown), the purpose of which is to convey a predetermined quantity of liquefied carbon dioxide from the tank 16 to vaporizer 18, a second steerable valve (not shown) connecting the liquefied carbon dioxide vaporizer 18 with the interior of the flexible hull 11, the purpose of which is to admit a predetermined quantity of pressurized carbon dioxide into the interior of the flexible hull so as to balance the pressure of water exerted on the flexible hull 11 as the vehicle submerge depth increases, and a third steerable valve (a wastegate, not shown) connecting the interior of the flexible hull 11 with ambient space, the purpose of which is to let off a predetermined quantity of pressurized carbon dioxide from the interior of the flexible hull to ambient space so as to balance the pressure of water exerted on the flexible hull 11 as the vehicle submerge depth decreases.

Placed inside the flexible hull 11 there is also a source of energy, preferably in the form of an accumulator (electric or hydraulic) 19, the purpose of which is to supply power to the vehicle 10 various devices, including the actuator 171 driving the flexible hull 10 length varying system, main engine (not shown) driving the propeller 15, and the pressure balancing system three main valves.

I claim:

1. Unmanned underwater vehicle, wherein in combination: said unmanned underwater vehicle has a variable buoyancy hull made of a flexible pipe and an external backbone, wherein said variable buoyancy hull has a front part made of the flexible pipe placed in front of the center of mass of the unmanned underwater vehicle, and a rear part made of the flexible pipe placed rearwardly relative the center of mass of the unmanned underwater vehicle; wherein said front part of said variable buoyancy hull made of the flexible pipe has a first end and a second end, and said rear part of said variable buoyancy hull made of the flexible pipe has a third end and a fourth end; wherein said variable buoyancy hull has a longitudinal axis of symmetry; wherein said external backbone consists of a first number K1 of longitudinal guides, and a second number K2 of transverse rings; wherein a third number K3<K2 of said second number K2 of said transverse rings are mounted slidingly on said first number K1 of said longitudinal guides, and a fourth number K4<K2 of said transverse rings are mounted fixedly on said first number K1 of longitudinal guides; wherein each longitudinal guide of said first number K1 of said longitudinal guides extends parallel to said longitudinal axis of symmetry of the variable buoyancy hull made of the flexible pipe; wherein the plane of each transverse ring of said second number K2 of said transverse rings is perpendicular to said longitudinal axis of symmetry of the variable buoyancy hull made of flexible pipe; wherein a fifth number K5<K3 of said transverse rings of said third number K3 of said transverse rings mounted slidingly on said first number K1 of said longitudinal guides are attached fixedly to said front part of said variable buoyancy hull made of the flexible pipe, wherein the first transverse ring of said fifth number K5 of said transverse rings mounted slidingly on said first number K1 of said longitudinal guides is attached fixedly to said first end of said front part of said variable buoyancy hull made of the flexible pipe, and the first transverse ring of said fourth number K4<K2 of said transverse rings mounted fixedly on said first number K1 of longitudinal guides is attached fixedly to said second end of said front part of said variable buoyancy hull made of a flexible pipe; wherein a sixth number K6<K3 of said transverse rings of said third number K3 of said transverse rings mounted slidingly on said first number K1 of said longitudinal guides are attached fixedly to said rear part of said variable buoyancy hull made of the flexible pipe, wherein the last transverse ring of said sixth number K6 of said transverse rings of said third number K3 of said transverse rings mounted slidingly on said first number K1 of said longitudinal guides is attached fixedly to said fourth end of said rear part of said variable buoyancy hull made of the flexible pipe, and the last transverse ring of said fourth number K4<K2 of said transverse rings mounted fixedly on said first number K1 of longitudinal guides is attached fixedly to said third end of said rear part of said variable buoyancy hull made of a flexible pipe; wherein the transverse ring of said second number K2 of said transverse rings bearing a number k=2, . . . , K2-1 is placed between the transverse ring of said second number K2 of said transverse rings bearing a number k−1=1, 2, . . . , K2-1 and the transverse ring of said second number K2 of said transverse rings bearing a number k+1=3, . . . , K2 measured along said longitudinal axis of the variable buoyancy hull made of flexible pipe.

2. Unmanned underwater vehicle according to claim 1, wherein the length of said front part of said variable buoyancy hull made of flexible pipe can vary so as to vary the buoyancy of said front part of said variable buoyancy hull made of flexible pipe, and to displace the center of buoyancy of said front part of said variable buoyancy hull made of flexible pipe relative the center of mass of said un manned underwater vehicle; wherein the length of said rear part of said variable buoyancy hull made of flexible pipe can vary so as to vary the buoyancy of said rear part of said variable buoyancy hull made of flexible pipe, and to displace the center of buoyancy of said rear part of said variable buoyancy hull made of flexible pipe relative the center of mass of said un manned underwater vehicle; wherein the variation of the length of the front part of said variable buoyancy hull made of flexible pipe is independent of the variation of the length of the rear part of said variable buoyancy hull made of flexible pipe.

3. Unmanned underwater vehicle according to claim 1, wherein said first end of said front part of the variable buoyancy hull made of flexible pipe is closed by a first copula, and said fourth end of said rear part of the variable buoyancy hull made of flexible pipe is closed by a second copula, so as said variable buoyancy hull made of a flexible pipe constitutes a watertight vessel.

4. Unmanned underwater vehicle according to claim 2, wherein a first length-varying mechanism of said front part of said variable buoyancy hull made of flexible pipe is placed in said variable buoyancy hull made of flexible pipe, wherein said first length-varying mechanism of said front part of said variable buoyancy hull made of flexible pipe has at least a first member, and a second member, wherein said first member of said first length-varying mechanism of said front part of said variable buoyancy hull made of flexible pipe is connected with said second member of said first length-varying mechanism of said front part of said variable buoyancy hull made of flexible pipe in such a way that the distance between said first member of said first length-varying mechanism of said front part of said variable buoyancy hull made of flexible pipe and said second member of said first length-varying mechanism of said front part of said variable buoyancy hull made of flexible pipe can vary.

5. Unmanned underwater vehicle according to claim 2, wherein a second length-varying mechanism of said rear part of said variable buoyancy hull made of flexible pipe is placed in said variable buoyancy hull made of flexible pipe, wherein said second length-varying mechanism of said rear part of said variable buoyancy hull made of flexible pipe has at least a third member, and a fourth member, wherein said third member of said second length-varying mechanism of said rear part of said variable buoyancy hull made of flexible pipe is connected with said fourth member of said second length-varying mechanism of said rear part of said variable buoyancy hull made of flexible pipe in such a way that the distance between said third member of said second length-varying mechanism of said rear part of said variable buoyancy hull made of flexible pipe and said fourth member of said second length-varying mechanism of said rear part of said variable buoyancy hull made of flexible pipe can vary.

6. Unmanned underwater vehicle according to claim 4, wherein said first member of said first length-varying mechanism of said front part of said variable buoyancy hull made of flexible pipe is connected to said first end of said front part of said variable buoyancy hull made of flexible pipe, and said second member of said first length-varying mechanism of said front part of said variable buoyancy hull made of flexible pipe is connected to said second end of said front part of said variable buoyancy hull made of flexible pipe.

7. Unmanned underwater vehicle according to claim 5, wherein said third member of said second length-varying mechanism of said rear part of said variable buoyancy hull made of flexible pipe is connected to said third end of said rear part of said variable buoyancy hull made of flexible pipe, and said fourth member of said second length-varying mechanism of said rear part of said variable buoyancy hull made of flexible pipe is connected to said fourth end of said rear part of said variable buoyancy hull made of flexible pipe.

8. Unmanned underwater vehicle according to claim 4, wherein said first length-varying mechanism of said front part of said variable buoyancy hull made of flexible pipe comprises a first group of a seventh number K7 of linear or rotary pneumatic actuators, wherein each pneumatic actuator of said first group of the seventh number K7 of linear or rotary pneumatic actuators has at least a body, and a sliding piston or a rotary piston, wherein said body of at least one pneumatic actuator of said first group of the seventh number K7 of linear or rotary pneumatic actuators is connected to at least one transverse ring of said second number K2 of said transverse rings, and the piston of said at least one pneumatic actuator of said first group of said seventh number K7 of linear or rotary pneumatic actuators is connected to another transverse ring of said second number K2 of said transverse rings.

9. Unmanned underwater vehicle according to claim 5, wherein said second length-varying mechanism of said rear part of said variable buoyancy hull made of flexible pipe comprises a second group of an eighth number K8 of linear or rotary pneumatic actuators, wherein each pneumatic actuator of said second group of said eighth number K8 of linear or rotary pneumatic actuators has at least a body, and a sliding piston or a rotary piston, wherein said body of at least one pneumatic actuator of said second group of said eighth number K8 of linear or rotary pneumatic actuators is mounted fixedly to at least one transverse ring of said second number K2 of said transverse rings, and the piston of said at least one pneumatic actuator of said second group of said eighth number K8 of linear or rotary pneumatic actuators is mounted fixedly to another transverse ring of said second number K2 of said transverse rings.

10. Unmanned underwater vehicle according to claim 4, wherein said first length-varying mechanism of said front part of said variable buoyancy hull made of flexible pipe comprises a third group of a ninth number K9 of linear or rotary hydraulic actuators, wherein each hydraulic actuator of said third group of the ninth number K9 of linear or rotary hydraulic actuators has at least a body, and a sliding piston or a rotary piston, wherein said body of at least one hydraulic actuator of said third group of the ninth number K9 of linear or rotary hydraulic actuators is connected to at least one transverse ring of said second number K2 of said transverse rings, and the piston of said at least one hydraulic actuator of said third group of said ninth number K9 of linear or rotary hydraulic actuators is connected to another transverse ring of said second number K2 of said transverse rings.

11. Unmanned underwater vehicle according to claim 5, wherein said second length-varying mechanism of said rear part of said variable buoyancy hull made of flexible pipe comprises a fourth group of a tenth number K10 of linear or rotary hydraulic actuators, wherein each hydraulic actuator of said fourth group of said tenth number K10 of linear or rotary hydraulic actuators has at least a body, and a sliding piston or a rotary piston, wherein said body of at least one hydraulic actuator of said fourth group of said tenth number K10 of linear or rotary hydraulic actuators is connected to at least one transverse ring of said second number K2 of said transverse rings, and the piston of said at least one hydraulic actuator of said fourth group of said tenth number K10 of linear or rotary hydraulic actuators is connected to another transverse ring of said second number K2 of said transverse rings.

12. Unmanned underwater vehicle according to claim 4, wherein said first length-varying mechanism of said front part of said variable buoyancy hull made of flexible pipe comprises a fifth group of an eleventh number K11 of linear or rotary electric actuators, wherein each electric actuator of said fifth group of said eleventh number K11 of linear or rotary electric actuators has at least a body, and a slider or a rotor, wherein said body of at least one electric actuator of said fifth group of said eleventh number K11 of linear or rotary electric actuators is connected to at least one transverse ring of said second number K2 of said transverse rings, and the slider or rotor of said at least one electric actuator of said fifth group of said eleventh number K11 of linear or rotary electric actuators is connected to another transverse ring of said second number K2 of said transverse rings.

13. Unmanned underwater vehicle according to claim 5, wherein said second length-varying mechanism of said front part of said variable buoyancy hull made of flexible pipe comprises a sixth group of an twelfth number K12 of linear or rotary electric actuators, wherein each electric actuator of said sixth group of said twelfth number K12 of linear or rotary electric actuators has at least a body, and a slider or a rotor, wherein said body of at least one electric actuator of said sixth group of said twelfth number K12 of linear or rotary electric actuators is connected to at least one transverse ring of said second number K2 of said transverse rings, and the slider or rotor of said at least one electric actuator of said sixth group of said twelfth number K12 of linear or rotary electric actuators is connected to another transverse ring of said second number K2 of said transverse rings.

14. Unmanned underwater vehicle according to claim 1, wherein a pressure balancing system is mounted on said external backbone, wherein said pressure balancing system comprises at least a compressed or liquefied gas tank, a first valve connecting said compressed or fluidized gas tank with the interior of said variable buoyancy hull made of flexible pipe, and a second valve connecting the interior of said variable buoyancy hull made of flexible pipe with ambient space; wherein opening said first valve with closed second valve causes the filling of said variable buoyancy hull made of flexible pipe with ambient space with compressed gas, wherein the pressure of said compressed gas filling said variable buoyancy hull made of flexible pipe is such that said pressure of said compressed gas filling said variable buoyancy hull made of flexible pipe balances the pressure the ambient water exerts on said variable buoyancy hull made of flexible pipe; wherein opening said second valve with closed said first valve causes letting off of the compressed gas from the interior of said variable buoyancy hull made of flexible pipe to ambient space.

* * * * *